US005612665A

United States Patent [19]

Gerhardsen

[11] Patent Number: 5,612,665

[45] Date of Patent: Mar. 18, 1997

[54] ESCAPE ROUTE INDICATION SYSTEM

[76] Inventor: Arne Gerhardsen, Haugland, N-1850 Mysen, Norway

[21] Appl. No.: 619,272

[22] Filed: Mar. 18, 1996

Related U.S. Application Data

[63] Continuation of Ser. No. 256,243, filed as PCT/NO92/00207, Dec. 29, 1992, abandoned.

[30] Foreign Application Priority Data

Jan. 2, 1992 [NO] Norway ..... 92 0027

[51] Int. Cl.[6] ..... G08B 5/00

[52] U.S. Cl. ..... 340/332; 340/815.4; 340/815.69; 362/73; 362/146

[58] Field of Search ..... 340/332, 815.4, 340/815.69; 362/73, 146

[56] References Cited

U.S. PATENT DOCUMENTS

| | | | |
|---|---|---|---|
| 3,131,871 | 5/1964 | Foulds | 362/146 |
| 3,408,025 | 10/1968 | Davis | 244/118.5 |
| 3,969,720 | 7/1976 | Nishino | 340/815.69 |
| 4,179,160 | 12/1979 | Sabo | 116/208 |
| 4,394,718 | 7/1983 | Balzer | 362/146 |
| 5,099,402 | 3/1992 | Starniri | 362/146 |
| 5,347,434 | 9/1994 | Drake | 362/73 |

FOREIGN PATENT DOCUMENTS

| | | |
|---|---|---|
| 0261811 | 3/1988 | European Pat. Off. . |
| 0323682 | 7/1989 | European Pat. Off. . |
| 2494875 | 5/1982 | France . |
| 2157470 | 10/1985 | United Kingdom . |
| 8904410 | 5/1989 | WIPO . |
| 9116513 | 10/1991 | WIPO . |

*Primary Examiner*—Jeffery Hofsass
*Assistant Examiner*—Edward Lefkowitz
*Attorney, Agent, or Firm*—Poms, Smith, Lande & Rose

[57] ABSTRACT

In order to provide specific information, e.g. concerning emergency exits on ships, in aeroplanes, in buildings, in specific land areas etc. there is provided a device in the form of a profile strip (1) along the path which has to be followed. The profile strip (1) is preferably installed along the walls in the form of a handrail. The profile strip (1) is designed in certain areas for the insertion of information supplying means (2) which may consist of signs and/or light panels and/or sound devices and/or direction indicating lugs or grooves. In the strip there may be cavities for providing any necessary cables for activation of the means.

20 Claims, 2 Drawing Sheets

ESCAPE ROUTE INDICATION SYSTEM

Figure 1:
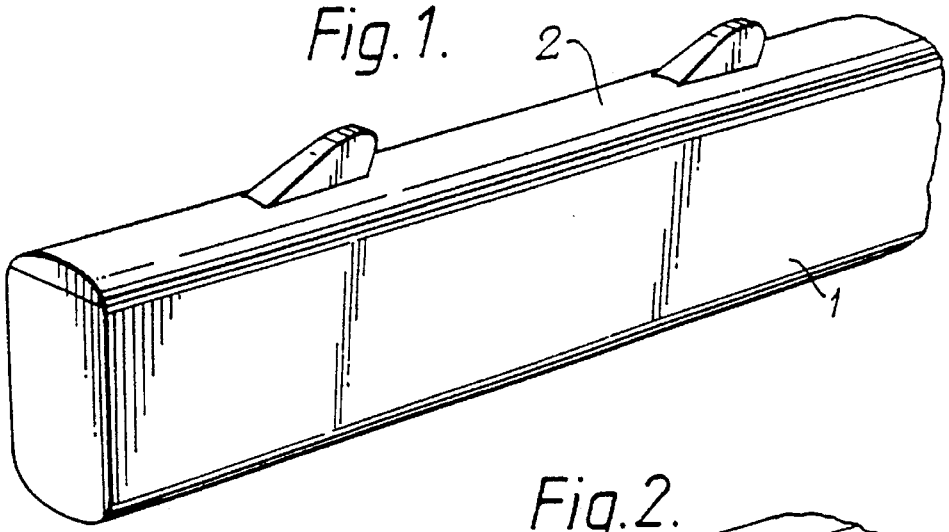

This application is a continuation of U.S. patent application Ser. No. 08,256,243, filed as PCT/NO92/00207, Dec. 29, 1992 abandoned.

The invention concerns a device for providing specific information, e.g. concerning emergency exits on ships, in aeroplanes, in buildings, information on specific land areas, etc. The device is particularly intended to provide information where it is absolutely vital that specified instructions/routes should be followed or in a crisis situation where it may be difficult to recognize one's surroundings.

At present a number of methods exist for indicating emergency routes or specific routes which should be followed. Moreover a number of signals are used in order to indicate special exits etc. The most commonly used method is signs, which may be lit up or luminous and which are located up on the wall or over doors. Another method which is used, e.g. on planes and on ships, is light strips which are inserted in the floor or walls and grooved handrails have also been designed, in which the grooves indicate specific directions. Furthermore special light panels have been developed in order to provide clearer information. All of these indicators normally satisfy the requirements which have to be met, but in crisis situations problems can still arise. In the case of a fire and the heavy build-up of smoke, for example, it can be quite impossible to see signs which are high up, there can be power cuts and it can be easy to become disoriented. Manual guidance systems in the form of handrails provide a very favourable solution, but it may be necessary to supply further information in addition to that which can be deduced from the shape of a handrail, even with grooves in a specific direction.

A further problem with most known methods is that assembly is time consuming and substantial expenses can very easily be incurred particularly in the integration of the emergency signals in walls or floor and in installing cables etc. especially if these have to be installed in a safe manner.

The object of the invention is to simplify the provision of information supplying means in such a way that these can be provided in a considerably more reasonable and uncomplicated manner, while at the same time the means will be easy to observe and be easily registered and utilized by those who have to follow the information. A further object is to be able to combine several of the known methods, thus obtaining the most efficient supply of information possible. Furthermore a safeguard will be obtained against destruction of the means, especially by fire.

These objects are achieved with a device which is characterized by the features in the claims presented.

The device according to the invention is constructed in the form of a profile strip and the special feature of the invention is that this strip not only serves as a means of attachment for the information supplying means, but is also given a further function, with the result that it is not purely a supporting element for the means or an additional element to the existing building construction. By the use of the profile strip which forms part of the device according to the invention, e.g. as a handrail, a simple and correct positioning of the information supplying means is obtained while at the same time the handrail provides a purely physical aid for people in finding their way.

The profile strip can be solid with cut-outs to hold the information supplying means or it can be a hollow profile strip with one or more internal spaces which can be covered in order to form a closed space. Typical examples are a square profile, an H-profile and a U-profile.

If problems arise with the handrail due to many doors in a corridor and if an additional safeguard is required in the case of smoke-filled passages, strips and cables can be led along the floor with branch cables up to the handrail. In this way the emergency routes can be doubly secured.

In the open air, on offshore platforms etc., the means can be integrated as parts of normal handrails and uprights.

Figure 2:
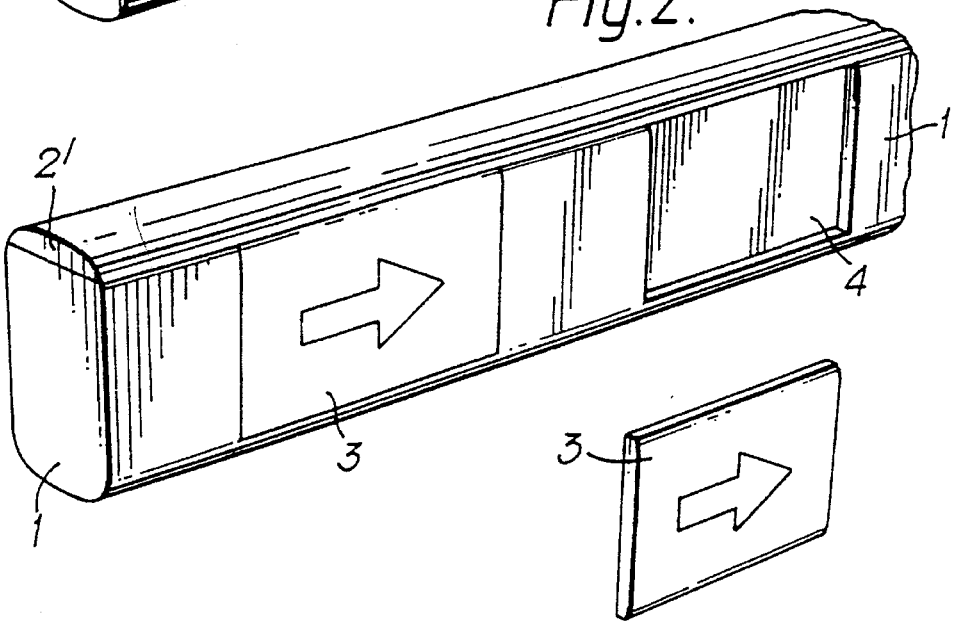
Figure 3:
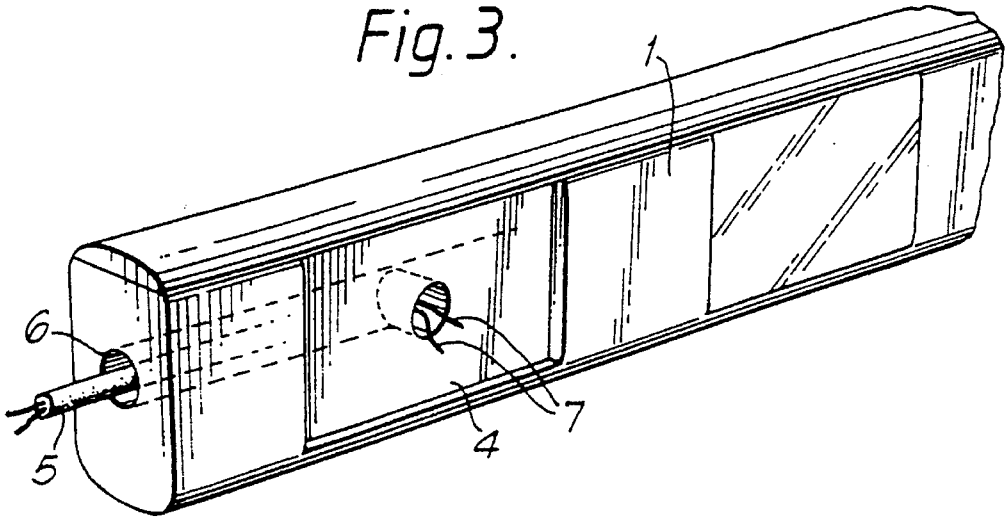
Figure 4:
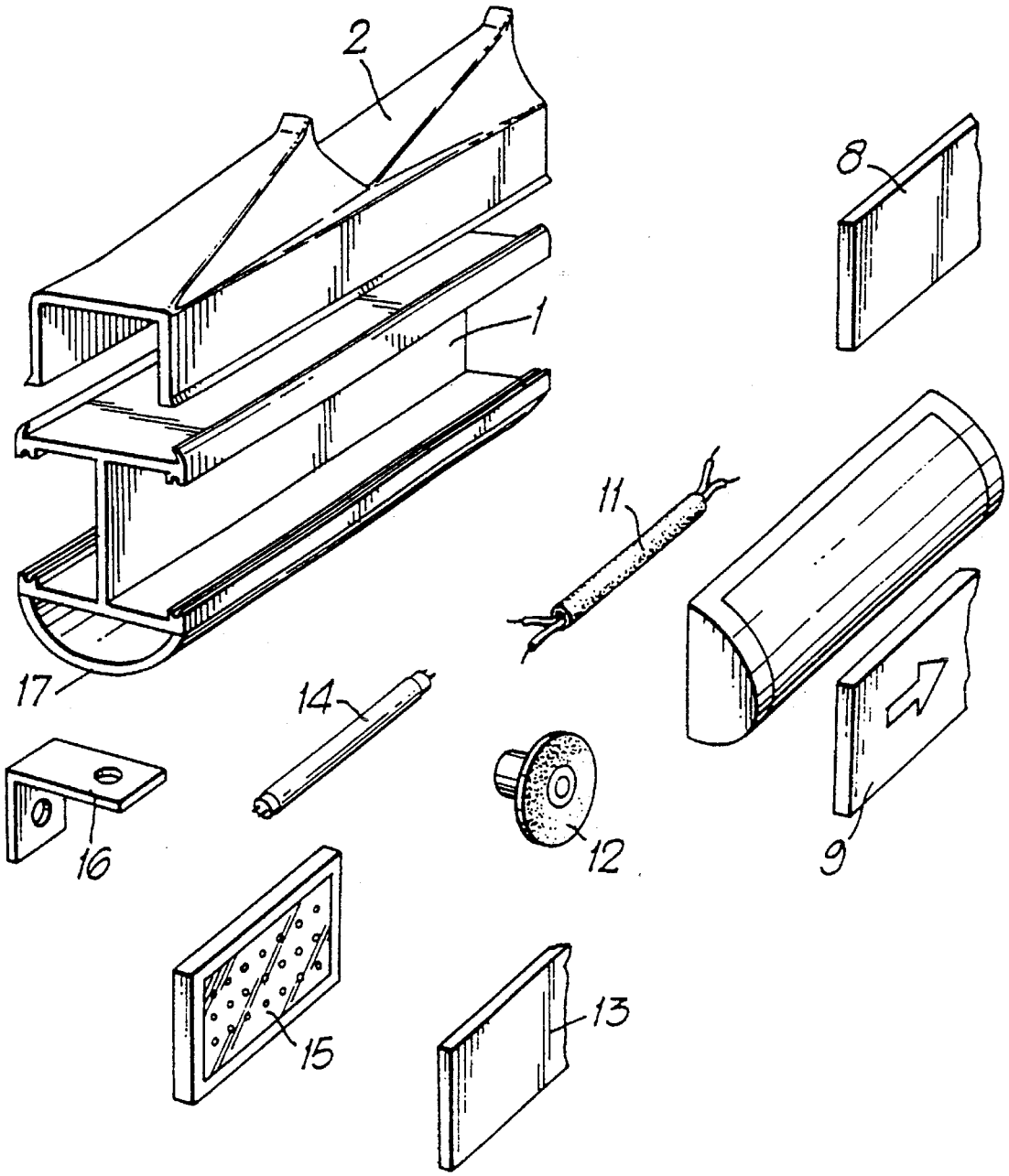

The invention will now be illustrated in more detail by means of embodiments which show:

FIGS. 1–3 are perspective views which illustrate the device according to the invention designed as solid strips, and FIG. 4 is an illustration of the invention in the form of a hollow profile, with the parts of the device separated from one another and where the drawing illustrates different information supplying means which can be installed.

The device according to the invention is preferably composed of a number of units of length or modules which can be assembled, e.g. to form a handrail of a desired length, thus making it possible to instal corner elements etc., according to requirements. For indoor use, on ships etc., the device should be made of a fireproof material. This requirement is not so essential if the device is used as information supplying railings, handrails or the like, e.g. over a land area. The device is also preferably equipped with attachment elements for fitting to a base, but can also be designed in such a manner that it can be integrated in the base or attached directly without separate attachment elements. It is possible to construct the device from a solid material or from a hollow profile strip. These two alternatives are illustrated in FIGS. 1–3 and FIG. 4 respectively.

Thus FIG. 1 illustrates in a perspective view a simple version of a device according to the invention which is used as a handrail and where there is provided only one information supplying means, viz. a direction-indicating lug rail. The actual profile strip or handrail is indicated by 1, while the lug rail is indicated by 2 and is provided on the top of the handrail. A handrail of this kind is previously known per se and reference is made to Norwegian patent application no. 90 1693. In the invention, however, the actual profile strip 1 in FIG. 1 is designed for the installation or insertion of a strip, such as the lug rail 2 illustrated in FIG. 1. The profile strip 1 thus forms a basic element on which the desired information supplying means can be installed. In FIG. 2 a second embodiment is illustrated in which the top of the profile strip 1 is covered by a rounded strip 2' in order to provide a suitable shape for a handrail strip. On the side of the strip 1 here, however, there are provided cut-outs 4 in which are installed signs with the desired information. In FIG. 2 these signs are indicated by 3 and are illustrated as arrow signs. Other types of information can be provided in a similar manner and fluorescent signs, for example, can be used.

FIG. 3 illustrates another version of FIG. 2. In this embodiment there is provided in the longitudinal direction of the profile strip 1 a boring 6 through which a set of wires can be pulled as schematically illustrated by 5. In each cut-out 4 there is a hole through which connection wires 7 can be pulled in order to provide illumination for the sign on the outside, or displays can be provided in the cut-outs which can supply information etc.

In FIG. 4 there is illustrated an embodiment in which the profile strip is designed as a metal profile, e.g. of aluminium with an H-shape. In the edges of the steps there are provided attachment means for cover plates of different kinds, in such a way that on the basis of an H-profile 1 of this kind, a wide variety of devices can be provided, all in accordance with the invention. In FIG. 4 a number of such alternatives are illustrated. Thus, for example, on the top of H-profile strip 1 there is provided a lug profile 2 of the same kind as that illustrated in FIG. 1. Since electrical wires can be passed through the hollow profile and supplied to other equipment, for which there would be sufficient space, it is a simple matter here too to provide reversible lug devices if it should be necessary to change direction for some reason. Such designs for changing the direction of lug devices of this kind are described in Norwegian patent application no. 90 4462.

On the outside of the hollow profile 1 a number of different bodies can be fastened or attached. In the figure there is illustrated, e.g., a marker strip or a sign 9 which corresponds to the signs 4 in FIG. 2. Between these signs, cover plates 8 of the desired shape can be provided.

Other types of information supplying elements which can be provided are light markers as illustrated by 10, which can contain signs or act purely as light indicators. In the interior of the hollow strip there are thereby located electrical cables which are schematically indicated by 11. These are necessary if light indicators or the like are used. Moreover in the side surface there can be installed loudspeakers 12 and possibly also microphones, thus providing communication with a central source. In the cover plate 8 permanent line indicators can also be integrated as illustrated by 13, continuous guide lights 14 can be provided which are followed as a strip along the edge of the handrail and light displays 15, e.g., can be integrated in which a variety of information is provided. The light display can also be an LCD screen.

The lower edge of the hollow profile strip 1 can be completed with a rounded profile piece 17, which, e.g., can also replace the continuous guide light 14 or provide illumination downwards in the direction of the floor and thus provide a light effect which can be very helpful.

It should be apparent from this illustration that with a design in accordance with the invention it will be possible to provide on the handrail level a number of different information supplying means according to the requirements of the individual case, thus achieving a very comprehensive range of application possibilities. Furthermore the major benefit is obtained of providing all information at a very favourable height which will be easy to read and will also be easy to see in passages etc. In order to supplement such information or if it is necessary to supply further information at a higher or lower level, branch pieces can be provided which are connected with the handrail, thus supplying additional information higher up or lower down. Thus many modifications are possible within the scope of the invention. The principal features of the invention are therefore the special placement, the easy installation, which is demonstrated in FIG. 4 in a purely general manner with the attaching bracket 16 and the possibility of designing the device in advance exactly according to requirements, a process which can be performed at a workshop or the like, whereupon the device is conveyed in module form to the assembly location and installed by means of brackets 16 in a simple and rapid fashion. This solution is both time-saving as well as extremely favourable from the financial point of view. It should be noted that the individual elements of an information supplying nature which are installed or can be installed in the device according to the invention do not in themselves constitute any part of the invention, the invention consisting in the integration of such means in a particularly opportune manner in order to achieve the special device.

I claim:

1. A modular handrail that conveys directional information to a user, said handrail having a top and a side, comprising:

a hollow profile strip that provides a basic supporting structure for the handrail, said profile strip comprising a plurality of modules each having a predetermined, modular length;

electrical connection wires running through and being substantially concealed by said profile strip; and a plurality of cover plates, said cover plates being removably attached to said hollow profile strip on at least two longitudinal sides of said strip to form an outer surface of the handrail, at least some of said cover plates having a directional indication;

wherein said cover plates together provide substantially the complete outer surface of the rail, wherein some of said cover plates are top cover plates and the others of said cover plates are side cover plates, said top cover plates forming the entire top of said handrail, and wherein the side of said handrail is substantially free of indentations and gaps in between said side cover plates such that the side of said handrail is substantially continuous.

2. A modular handrail as defined in claim 1, wherein said hollow profile strip has a substantially H-profile.

3. A modular handrail as defined in claim 1, wherein said hollow profile strip has a substantially square profile.

4. A modular handrail as defined in claim 1, wherein some of said cover plates are top cover plates for defining a top of the rail, said top cover plates having a surface with lugs, said lugs providing a user with information as to which direction to walk along the handrail.

5. A modular handrail as defined in claim 4, wherein said lugs have an orientation, and wherein that orientation is adjustable.

6. A modular handrail as defined in claim 1, wherein some of said top cover plates have a surface with grooves, said grooves providing a user with information as to which direction to walk along the handrail.

7. A modular handrail as defined in claim 6, wherein at least some of said top cover plates have lugs protruding upwardly therefrom, said lugs having direction orientation to guide a user to walk in a particular direction during an emergency.

8. A modular handrail as defined in claim 1, wherein the handrail further comprises branch pieces that have a directional indication, wherein said branch pieces may be connected to and extend from the handrail in order to provide directional information at a distance away from the handrail.

9. A modular handrail as defined in claim 1, wherein said hollow profile strip is a solid material having cavities in which wires are passed, and having a plurality of cut-outs on at least two sides of said profile strip in which cover plates may be inserted, said cover plates providing information to the user as to the proper direction in which to walk along said handrail.

10. A modular handrail that conveys information to a user with interchangeable cover plates, the handrail having a top, comprising:

a hollow profile strip that provides a basic supporting structure for the handrail, said profile strip comprising a plurality of modules each having a predetermined, modular length, said profile strip having a top and a side;

a plurality of interchangeable top cover plates that individually attach to the top of said profile strip to form the entire top of the handrail, at least some of said top cover plates comprising top rails having a directional indication oriented in a first direction and at least some of the other top rails being substantially smooth;

a plurality of interchangeable side cover plates that individually attach to at least one side of said profile strip, said side cover plates comprising at least one cover plate having a directional indication in the first direction and at least one other cover plate being free of any directional indication;

wherein the handrail has a first mode in which said top and side cover plates having a directional indication oriented in said first direction are mounted onto said profile strip to direct users to move along the handrail in said first direction during an emergency, and a second mode in which said substantially smooth top cover plates and said side plates that are free of any directional indication are mounted onto said profile strip to provide no directional indication to a user.

11. A modular handrail as defined in claim 10, wherein at least some of said top cover plates include protrusions having a particular direction orientation to guide a user in the particular direction.

12. A modular handrail as defined in claim 10, wherein at least some of said top cover plates include grooves having a particular direction orientation to guide a user in the particular direction.

13. A modular handrail as defined in claim 10, wherein at least some of said side cover plates are signs having directional information for directing a user in a particular direction along the handrail.

14. A modular handrail as defined in claim 10, wherein the handrail further comprises electric wiring extending through and being concealed by said profile strip.

15. A modular handrail as defined in claim 10, wherein the handrail comprises at least one sound device for audibly providing information to a user.

16. A modular handrail as defined in claim 10, wherein the handrail further comprises a microphone for intercommunication between a user of the handrail and a central source.

17. A convertible handrail assembly comprising:

a basic supporting handrail structure; and a plurality of different interchangeable top cover plates for selectively mounting onto said basic supporting handrail structure to form the entire top of the handrail, at least some of said interchangeable top cover plates including protrusions that are oriented in a particular direction and at least some of the other interchangeable top cover plates being substantially smooth;

wherein said handrail has a first mode for use in an emergency to provide directional information to a user, in which said top cover plates having protrusions oriented in a particular direction are mounted onto said basic supporting handrail structure to form the entire top of the handrail, so that a user may run his hand over said protrusions to determine the direction in which he should walk during an emergency; and wherein said handrail has a second mode for normal use, in which said top cover plates that are substantially smooth are mounted onto said basic supporting handrail structure to form the entire top of the handrail, such that the top of the handrail is substantially smooth.

18. A method of converting a handrail having a top and a side from one configuration for use in an emergency to another configuration for normal use, the method comprising the steps of:

providing a handrail assembly comprising:

a basic supporting handrail structure; and a plurality of different interchangeable top cover plates for selectively mounting onto said basic supporting handrail structure to form the entire top of the handrail, at least some of said interchangeable top cover plates having protrusions oriented in a particular direction and at least some of the other interchangeable top cover plates being substantially smooth;

configuring said handrail for use in an emergency to provide directional information to a user, by mounting said top cover plates having protrusions oriented in a particular direction onto said basic supporting handrail structure to form the entire top of the handrail, wherein a user may run his hand over said protrusions to determine the direction in which he should walk during an emergency in order to locate an exit; and reconfiguring said handrail for normal use, by mounting said top cover plates that are substantially smooth onto said basic supporting handrail structure to form the entire top of the handrail, such that the top of the handrail is substantially smooth.

19. A method of converting a handrail as defined in claim 18, wherein said handrail assembly further comprises a plurality of side cover plates for selectively mounting onto one side of said basic supporting handrail structure, at least some of said side cover plates having a direction indication and at least some others of said side cover plates having no direction indication;

wherein the step of configuring said handrail for use in an emergency to provide directional information to a user further comprises attaching said side cover plates having a direction indication onto said basic supporting handrail structure; and wherein the side of said handrail is substantially free of indentations and gaps in between said side cover plates.

20. A method of converting a handrail as defined in claim 19, wherein at least some of said side panels are light panels that indicate a direction by way of light, and wherein the step of configuring said handrail for use in an emergency further comprises illuminating said light panels.

* * * * *